US005090462A

United States Patent [19]

Dimter

[11] Patent Number: 5,090,462

[45] Date of Patent: Feb. 25, 1992

[54] DOVETAIL CUTTING DEVICE AND METHOD

[76] Inventor: Erwin Dimter, Rudolf-Diesel-Strasse 12, 7918 Illertissen, Fed. Rep. of Germany

[21] Appl. No.: 640,245

[22] Filed: Jan. 11, 1991

[30] Foreign Application Priority Data

Jan. 12, 1990 [DE] Fed. Rep. of Germany ..... 4000804
Nov. 7, 1990 [DE] Fed. Rep. of Germany ..... 4035423

[51] Int. Cl.[5] ..... B27F 1/00

[52] U.S. Cl. ..... 144/347; 144/91; 156/304.1

[58] Field of Search ..... 144/2 R, 90 R, 90 A, 144/91, 347; 156/304.1

[56] References Cited

U.S. PATENT DOCUMENTS 4,130,150 12/1978 Cook et al. ..... 144/91
4,248,280 2/1981 Taylor ..... 144/91
4,856,569 8/1989 Robson ..... 144/347

*Primary Examiner*—W. Donald Bray
*Attorney, Agent, or Firm*—Robert W. Becker & Associates

[57] ABSTRACT

A dovetail cutting device and a method for the manufacture of dovetailings on the faces or ends of boards that are to be jointed face to face, in a continuous manner or individually, is provided. The dovetail cutting device comprises two tables that are facing one another and are slidable relative to one another for receiving and transporting boards that are stacked on edge. A pivotable abutment for aligning the boards when the tables are moved toward one another is disposed at each one of the tables on a side facing one another. A dovetail cutter is mounted between the tables in a slidable manner in a direction transverse to the direction of movement of the tables. It comprises, for example, a circular saw for cutting to size the faces or ends of the boards, a cutter for cutting the dovetailings, and a pasting device for providing the dovetailings with glue. Hydraulic working cylinders are provided for moving the tables and the dovetail cutter.

5 Claims, 3 Drawing Sheets

DOVETAIL CUTTING DEVICE AND METHOD

BACKGROUND OF THE INVENTION

The present invention relates to a dovetail cutting device and a method for the manufacture of dovetailings (fingers) on the faces or ends of boards that are to be jointed face to face in a continuous manner or individually.

In conventional methods for the manufacture of dovetail jointing or finger jointing, boards of various lengths are stacked on edge on a cutting table, with one of their respective faces or ends aligned to one another. The aligned faces of the stack of boards are then cut at a right angle relative to the length of the boards, for example, with a circular saw to yield a straight face or end of the stack of boards. Then the dovetailings (fingers) are cut into the boards to a length of 10 to 30 cm by a profile cutter. The dovetailings (fingers) are subsequently pasted with glue. In a further step, the boards are aligned with their respective opposite faces or ends and are provided with dovetailings (fingers) by a second set of machines or profile cutters. The dovetailings (fingers) are also pasted with glue. The dovetailings of the boards prepared in the above described manner are then joined together and pressed in a dovetail jointing press during the hardening of the glue.

The method of the prior art requires the use of two profile cutters for the two faces or ends of the boards. Therefore, the geometry of the two individual profile cutters must be exactly adjusted in order to ensure a perfect and exact jointing of the boards, especially to avoid gaps between the joints or crushing of the joints. It is especially important to have a perfect fit in order to ensure proper pasting. The jointing of the boards must be such that the static load and mechanical strength characteristics of the joint are comparable to that of natural wood. A typical problem of having two cutting tools for dovetailing is that the sharpening of the cutting tools usually results in misaligned and misadjusted geometries of the tools, thus requiring a time-consuming readjustment of the respective tool geometries and therefore long and costly shut-down periods. The double set of the cutting tools also requires significantly more space. It has been suggested to provide the cutting table with means for rotating it about 180° for boards that are 5 m or longer. This would allow for the use of only one cutting tool since the boards could be cut with the same cutter in the same position. However, this results in even greater space requirements and a throughput reduction.

It is therefore an object of the present invention to provide a dovetail cutting device that requires less space and is less expensive, while at the same time yields a higher throughput and is easier to operate.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
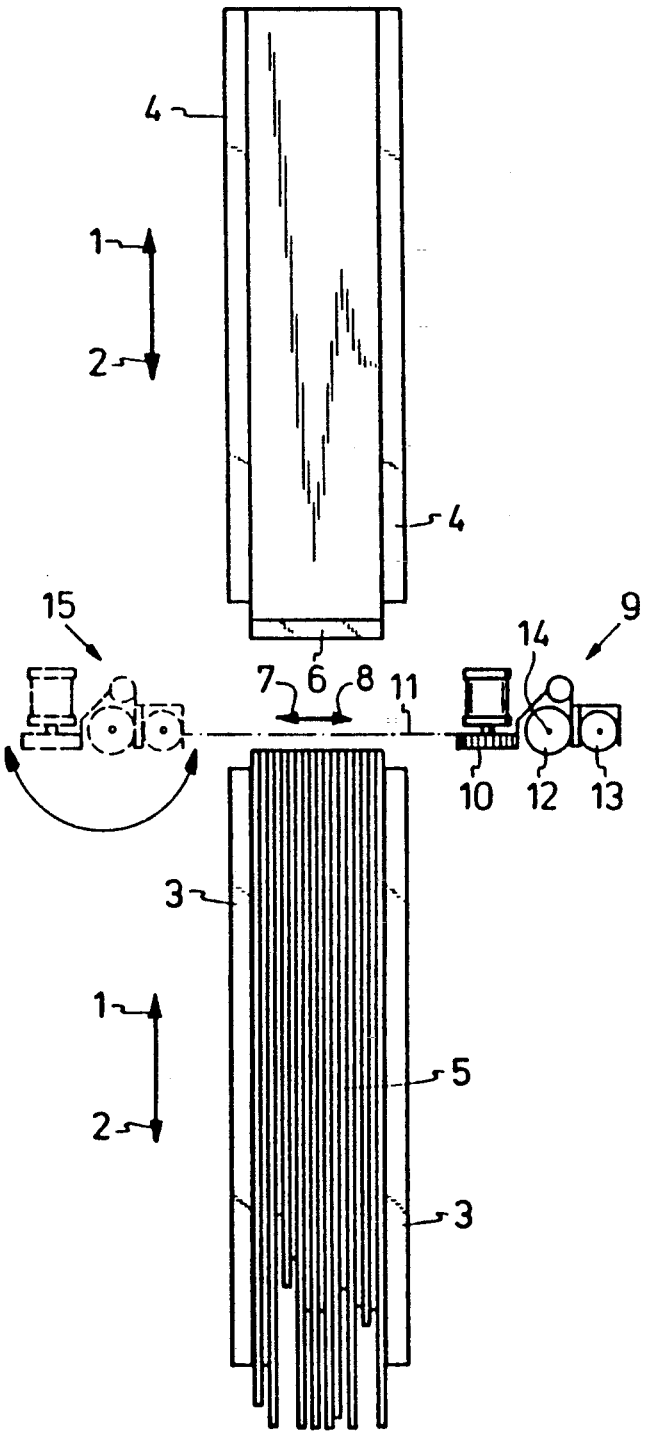
FIG. 1 is a plan view of a dovetail cutting device of the present invention.
Figure 2A:
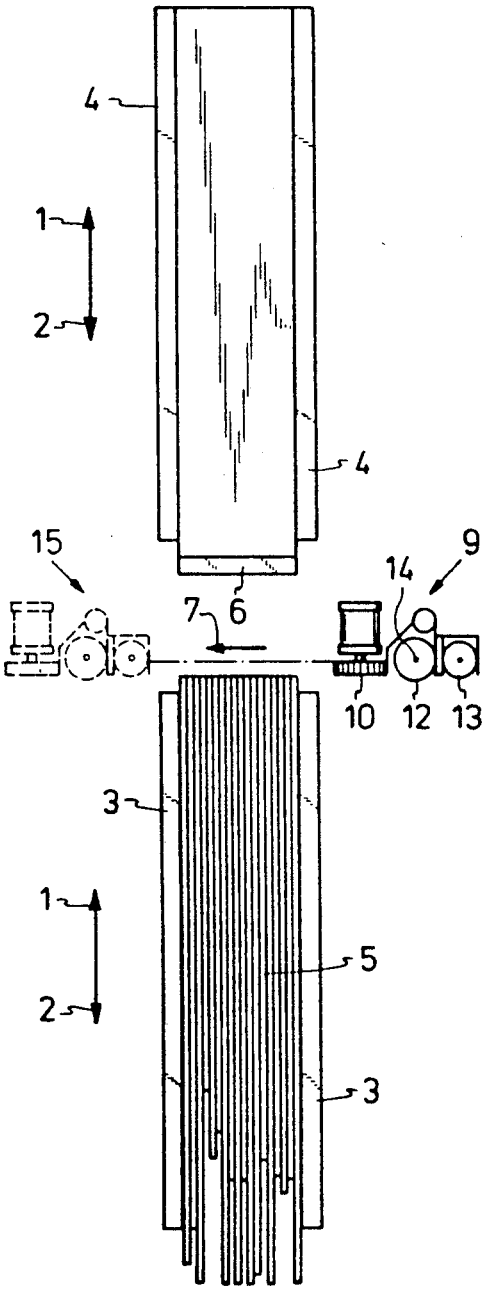
FIG. 2*a* shows the same dovetail cutting device at the beginning of the cutting of the face of a board stack.
Figure 2B:
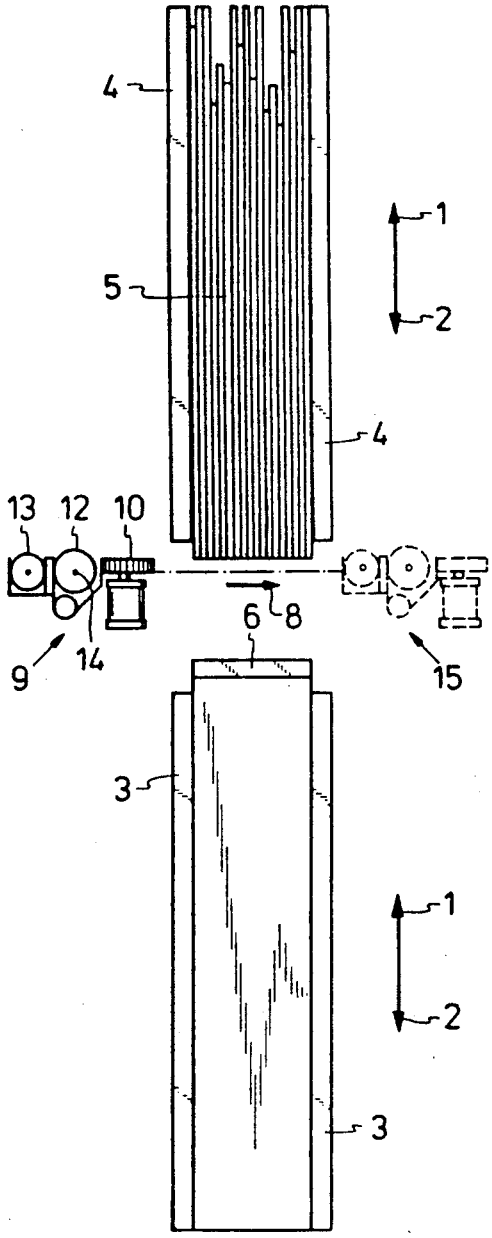
FIG. 2*b* at the beginning of the cutting of the opposite face or end of the same board stack.

The dovetail cutting device of the present invention is primarily characterized by two tables, that are facing one another and are slidable in a direction towards one another and away from one another, for receiving and transporting boards that are stacked on edge, whereby a pivotable abutment, for aligning the boards when the tables are moved toward one another, is disposed between facing sides of the tables. A dovetail cutting means, which is mounted in such a way as to be slidable between the tables in a direction transverse to the direction of movement of the tables, comprises a cutter for trimming the faces or ends of the boards, a dovetail cutter ( for cutting the dovetailings, and a pasting device for providing the dovetailings with glue. Hydraulic working cylinders for moving the tables and moving the dovetail cutting means in the transverse direction are provided.

In a further embodiment, the cutter is a circular saw.

In another embodiment, the dovetail cutting means is disposed on a support that is slidable in the transverse direction, whereby the dovetail cutting means, when positioned outside an area defined between the tables is rotatable 180° about a vertical axis of the dovetail cutter.

Another embodiment encompasses tables that are pivotable in their horizontal plane about a respective vertical axis for performing slanted cuts.

The method of the present invention is characterized by the following steps: receiving the boards by a first table which is movable in a direction of transport of the boards; aligning a first end of the boards against an abutment disposed in a working plane of a dovetail cutting means; removing the abutment from the aligned boards; moving the dovetail cutting means from an initial position in a direction transverse to the direction of transport of the boards, whereby the dovetail cutting means comprises a cutter, a dovetail cutter, and a pasting device, and trimming the boards with the cutter, cutting dovetailings into the boards with the dovetail cutter, pasting the dovetailings with glue with the pasting device; pivoting the dovetail cutting means 180° after reaching an end position in the transverse direction; moving the machined boards to a second table, that is facing the first table and is slidable in the direction of transport of the boards, by sliding the first and second table and toward one another such that the second table receives the boards, and subsequently moving the tables back into an initial position; aligning a second end of the boards with the abutment in the working plane of the dovetail cutter; moving the dovetail cutting means back in the direction transverse to the direction of transport of the boards, and trimming the second ends of the boards with the cutter, cutting dovetailings into the second ends of the boards with the dovetail cutter, pasting the dovetailings with glue with the pasting device; pivoting the dovetail cutting means 180° after reaching the initial position in the transverse direction.

The present invention improves the machining process and increases the speed of operation of the manufacture of dovetail jointed boards for the production of laminated beams. Both faces or ends of the automatically fed boards are cut and pasted in a programmable process. They may then be transported automatically to the dovetail jointing press. No manual labor, especially for the rotation of the boards, is necessary.

DESCRIPTION OF PREFERRED EMBODIMENTS

The present invention will now be described in detail with the aid of several specific embodiments utilizing FIGS. 1 to 4.

The dovetail cutting device represented in FIG. 1 is provided with two tables 3 and 4 that are slidable relative to one another in the direction of the arrows 1 and 2. The boards 5 to be machined are stacked on edge and are slidable via the tables 3 and 4 to an abutment 6 where they are aligned for the machining process. The dovetail cutting means 9 is slidable in front of the faces or ends of the boards 5 in the direction of the arrows 7 and 8 via working cylinders not represented. The dovetail cutting means 9 comprises a cutter 10 for cutting the ends of the boards 5 in the plane of the dashed line 11, a dovetail cutter 12 for cutting the dovetailings and a pasting device 13 with which the cut dovetailings are pasted with glue. The cutter 10, the dovetail cutter 12 and the pasting device 13 are arranged on a common support which is not represented in the drawing. The dovetail cutting means 9 is pivotable 180° on the support about the vertical axis 14 of the dovetail cutter 12.

The dovetail cutting device of the present invention functions as follows: The boards 5 of various lengths slide on the table 3 when the table 3 is moved backwards in the direction of the arrow 2. When the table 3 is again moved forward in the direction of the arrow 1, the boards 5 are aligned at the abutment 6 which has been positioned along the dashed line 11. Thereby the faces or ends of the boards 5 are arranged in the plane of the cutter 10. The dovetail cutting means 9 is then moved in the direction of the arrow 7, and the cutter 10 cuts off the ends of the boards 5 to form a straight cut, then the dovetailings are cut with the dovetail cutter 12, and subsequently the dovetailings are pasted with glue by the pasting device 13 (cf. FIG. 2*a*). At the end of these machining steps, the dovetail cutting means 9 is moved to the position 15 and is then pivoted 180° about the axis 14 of the dovetail cutter 12. At the same time, the tables 3 and 4 are moved towards one another so that the table 4 receives the stack of boards 5 when the tables 3 and 4 are moved away from one another in the direction of the arrows 1 and 2. After the abutment 6 has been placed in the position along the line 11 (as described for FIG. the opposite faces or ends of the boards 5 are aligned with the line 11 when the table 4 is moved back towards the abutment 6 in the direction of the arrow 2. The dovetail cutting means 9 is then moved in the direction of the arrow 8 whereby the cutter 10 cuts the ends of the boards 5, then the dovetail cutter 12 cuts the dovetailings, and subsequently the dovetailings are pasted with glue by the pasting device 13 (cf. FIG. 2*b*). After reaching the final position, the dovetail cutting means 9 is again pivoted 180° to assume its initial position and is ready for cutting the next stack of boards.

With this method, both ends of the boards 5 of various lengths are provided with geometrically identical dovetailings which are already pasted. The boards 5 may now be transported, individually and one after another, to the dovetail joint press where they are jointed to form an endless board.

Figure 3:
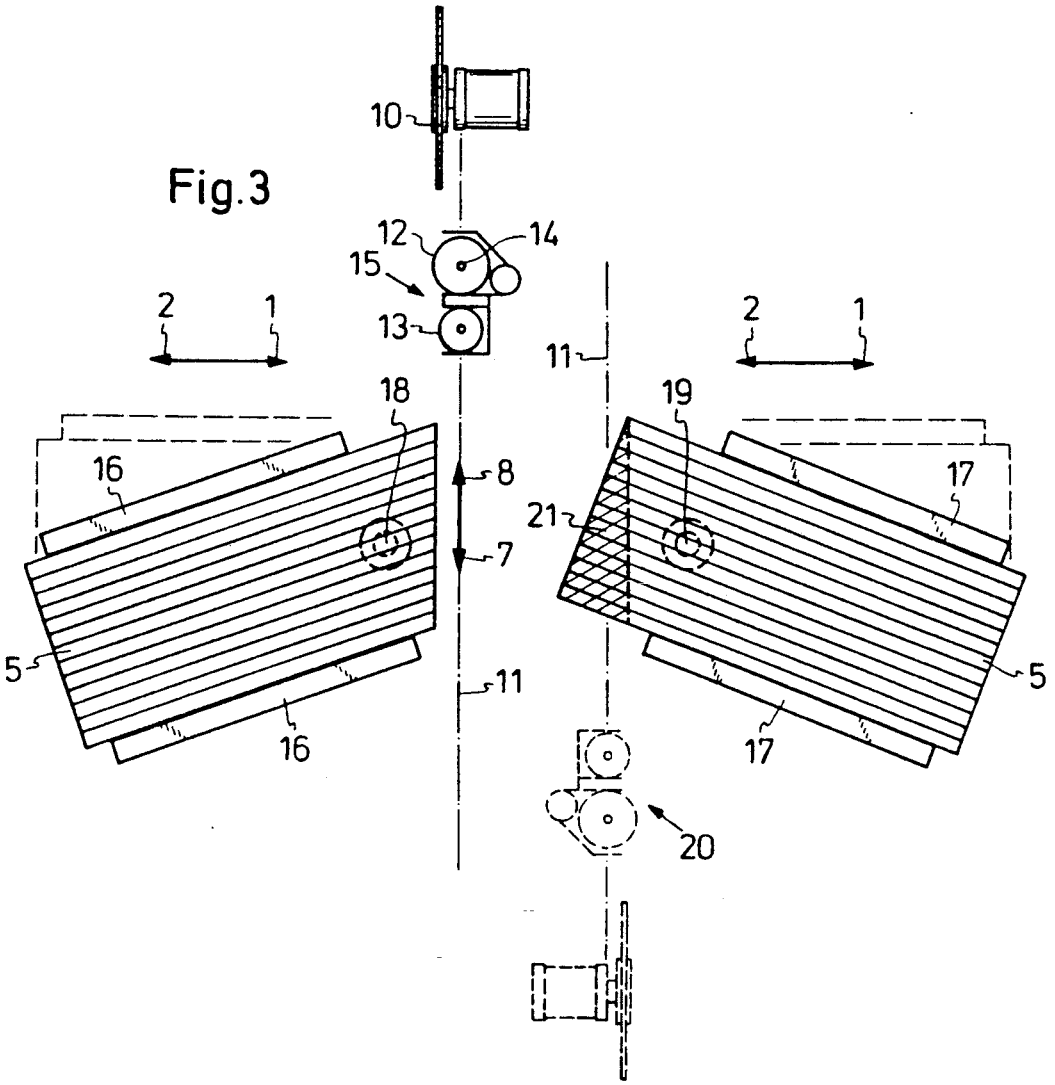
FIG. 3 is another embodiment of a dovetail cutting device of the present invention.

In the embodiment of FIG. 3 the tables 16 and 17 are pivotable in their horizontal plane about the vertical axes 18 and 19 so that slanted cuts may be performed. The arrangement of the dovetail cutting means 20 is identical to the arrangement of FIG. 1. The cutter 10 in this embodiment is a circular saw 10' because the boards are cut at an angle (as shown at 20 in FIG. 3) and not only trimmed to achieve a straight face or end.

In this embodiment, the dovetail cutting means 20 is also turned around after completion of the cutting and pasting steps and after being pivoted 180° in order to cut the opposite ends of the boards, as described above. After the completion of the return cutting cycle, it is then pivoted back into its initial position.

Figure 4:
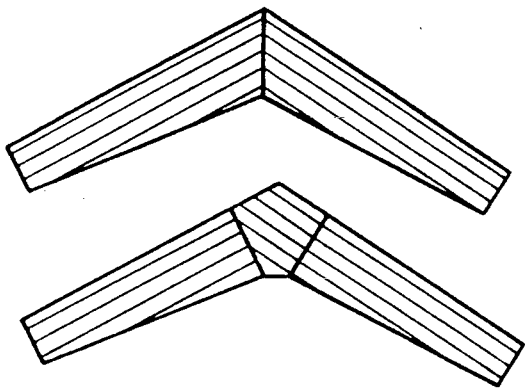
FIG. 4 shows examples of the wood constructions that are producible with the dovetail cutting device according to FIG. 3.

In FIG. 4, wood constructions from laminated beams are represented. Such laminated beams may be produced from the boards which are cut and provided with dovetailings by the arrangement of FIG. 3.

In the embodiments shown, the movement of the tables 3, 4, 16, 17 and the dovetail cutting means 9, 20, respectively their supports, may be performed with respective working cylinders. The entire hydraulic assembly may then be programmed corresponding to the machining process, thereby completely eliminating manual labor.

The present invention is, of course, in no way restricted to the specific disclosure of the specification, examples and drawings, but also encompasses any modifications within the scope of the appended claims.

What I claim is:

1. A dovetail cutting device for the manufacture of dovetailings on faces of boards that are to be jointed face to face, said dovetail cutting device comprising:

two tables, that are facing one another end-to-end and are slidable in a direction towards one another and away from one another, for receiving and transporting said boards that are stacked on edge, an abutment for aligning said boards when said tables are moved toward one another, said abutment being disposed at one of said tables in a pivotable manner at said facing ends of said tables to be retractable from a transport path of said boards;

a dovetail cutting means, which is mounted in such a way as to be slidable between said tables in a direction transverse to said direction of movement of said tables, comprising a cutter for trimming said faces of said boards, a dovetail cutter for cutting said dovetailings and a pasting device for providing said dovetailings with glue; and hydraulic working cylinders for moving said tables in said direction of movement of said tables and moving said dovetail cutting means in said transverse direction.

2. A dovetail cutting device according to claim 1, in which said cutter is a circular saw.

3. A dovetail cutting device according to claim 1, in which said dovetail cutting means is disposed on a support that is slidable in said transverse direction, with said dovetail cutting means, in an initial position and in an end position thereof, being rotatable 180° about a vertical axis of said dovetail cutter.

4. A dovetail cutting device according to claim 1, in which said tables are pivotable in a horizontal plane thereof about a respective vertical axis for performing slanted cuts.

5. A method for cutting dovetailings on faces of boards that are to be jointed face to face, including the steps of:

receiving said boards by a first table which is movable in a direction of transport of said boards;

aligning a first end of said boards against an abutment disposed in a working plane of a dovetail cutting means;

removing said abutment from said aligned boards;

moving a dovetail cutting means from an initial position thereof in a direction transverse to said direction of transport of said boards, said dovetail cutting means comprising a cutter, a dovetail cutter, and a pasting device, and trimming said boards with said cutter, cutting dovetailings into said boards with said dovetail cutter, pasting said dovetailings with glue with said pasting device;

pivoting said dovetail cutting means 180° after reaching an end position in said transverse direction;

moving said machined boards to a second table, that is facing said first table and is slidable in said direction of transport of said boards, by sliding said first and second table and toward one another such that said second table receives said boards, and subsequently moving said tables back into an initial position thereof;

aligning a second end of said boards with said abutment in said working plane of said dovetail cutting means;

moving said dovetail cutting means back in said direction transverse to said direction of transport of said boards, and trimming said second ends of said boards with said cutter, cutting dovetailings into said second ends of said boards with said dovetail cutter, pasting said dovetailings with glue with said pasting device;

pivoting said dovetail cutting means 180° after reaching said initial position in said transverse direction.

* * * * *